US011891262B2

(12) United States Patent
Van Dongen et al.

(10) Patent No.: US 11,891,262 B2
(45) Date of Patent: Feb. 6, 2024

(54) SHEET STACKER WITH SHEET FLIPPING CONFIRMATION

(71) Applicant: Canon Production Printing Holding B.V., Venlo (NL)

(72) Inventors: Peter J. W. Van Dongen, Venlo (NL); Dominique M. L. Perdaen, Venlo (NL); Christopher J. Borchert, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 0 days.

(21) Appl. No.: 18/054,038

(22) Filed: Nov. 9, 2022

(65) Prior Publication Data

US 2023/0159298 A1 May 25, 2023

(30) Foreign Application Priority Data

Nov. 23, 2021 (EP) ..... 21209928

(51) Int. Cl.
*B65H 43/04* (2006.01)
*B65H 29/40* (2006.01)
*B65H 31/18* (2006.01)

(52) U.S. Cl.
CPC ..... *B65H 43/04* (2013.01); *B65H 29/40* (2013.01); *B65H 2301/4212* (2013.01);
(Continued)

(58) Field of Classification Search
CPC ..... B65H 43/04; B65H 43/08; B65H 31/02; B65H 31/18; B65H 31/08; B65H 31/10;
(Continued)

(56) References Cited

U.S. PATENT DOCUMENTS 8,191,889 B1 * 6/2012 Cummings ..... B65H 31/04 271/155
9,457,980 B2 10/2016 Kuypers et al.
(Continued)

FOREIGN PATENT DOCUMENTS

JP 07053120 A * 2/1995
JP 2003026370 A * 1/2003
(Continued)

OTHER PUBLICATIONS

European Search Report, issued in Application No. 21 20 9928, dated May 13, 2022.

*Primary Examiner* — Luis A Gonzalez

(74) *Attorney, Agent, or Firm* — Birch, Stewart, Kolasch & Birch, LLP

(57) ABSTRACT

To ensure reliable and productive processing of printed sheets into stacks, a sheet stacker includes: a flipping device for flipping a sheet with respect to the sheet's orientation before being received by the flipping device onto a stack support or a stack of sheets on the stack support; a sensor assembly for detecting an out-of-plane deformation of a top sheet with respect to the underlying stack support or a stack of sheets on the stack support at least for each sheet added to the stack; and a controller configured to determine from data from the sensor assembly whether the top sheet was successfully flipped and stacked.

15 Claims, 3 Drawing Sheets

(52) U.S. Cl.
CPC .... *B65H 2511/24* (2013.01); *B65H 2553/412* (2013.01); *B65H 2801/03* (2013.01)

(58) Field of Classification Search
CPC .. B65H 29/40; B65H 29/38; B65H 2553/412; B65H 2553/42; B65H 2511/24; B65H 2511/17
See application file for complete search history.

(56) References Cited

U.S. PATENT DOCUMENTS

| | | | |
|---|---|---|---|
| 10,011,453 | B1 | 7/2018 | Dufort et al. |
| 2006/0208414 | A1 | 9/2006 | Amarakoon et al. |
| 2009/0121424 | A1 | 5/2009 | Eguchi |
| 2010/0207319 | A1 | 8/2010 | Sato et al. |
| 2014/0239578 | A1 | 8/2014 | Honda et al. |

FOREIGN PATENT DOCUMENTS

| | | | | |
|---|---|---|---|---|
| JP | 2005170649 | A | * | 6/2005 |
| JP | 4421283 | B2 | | 2/2010 |
| JP | 2012020840 | A | * | 2/2012 |
| JP | 2012188226 | A | * | 10/2012 |

* cited by examiner

SHEET STACKER WITH SHEET FLIPPING CONFIRMATION

BACKGROUND OF THE INVENTION

1. Field of the Invention

The invention relates to a sheet stacker and a method for printing sheets.

2. Description of Background Art

Sheet stackers may be provided at the output side of a printer for forming stacks of printed sheets. Certain sheet stackers comprise a flipping device which flips the sheet over as it is being stacked. During flipping a sheet may collapse upon itself. One or more sheets in the stack may then become unsuited for use and require reprinting and re-inserting these sheets back into the stack at the proper positions. This is generally considered cumbersome and affects productivity.

It is known from US2009121424, US10011453, US2006208414, and US2014239578 to provide a sensor assembly to detect deformations in the shape of the entire stack formed by a non-flipping stacker. These sensor assemblies focus on the stack and can track deviations that build up in the stack over a longer period.

SUMMARY OF THE INVENTION

It is an object of the invention to provide a sheet stacker with improved productivity, specifically a sheet stacker which can appropriately address wrongly flipped sheets.

In accordance with the present invention, a sheet stacker according to claim 1 and a method according to claim 15 are provided. The sheet stacker comprises:

- a flipping device for flipping a sheet with respect to the sheet's orientation before being received by the flipping device onto a stack support or a stack of sheets on said stack support;
- a sensor assembly for detecting an out-of-plane deformation of a top sheet with respect to the underlying stack support or a stack of sheets on said stack support at least for each sheet added to the stack;
- a controller configured to determine from data from the sensor assembly whether the top sheet was successfully flipped and stacked.

Using the sensor data the controller determines for each sheet flipped onto the stack whether said sheet has been correctly flipped. This check is performed for each sheet, from the first to the last sheet in the stack. Since all sheets in the stack have passed this check, it can be safely assumed that the stack has the desired stack integrity (no stacking faults). This is due to the fact that the check is performed for each sheet individually. When it is determined that a sheet has been incorrectly flipped, appropriate action can be taken and stacking can be easily resumed. Productivity is improved since the problem is limited to the last flipped sheet and can be quickly resolved. Stacking can be quickly resumed since the integrity of the underlying stack is ensured by checking that that each individual is correctly flipped or not. Thereby the object of the present invention has been achieved.

More specific optional features of the invention are indicated in the dependent claims.

In an embodiment, the sensor assembly is arranged to sense each sheet added to the stack individually after the respective sheet has been added to the stack. The sensor assembly is configured to check each sheet after it has been added to the stack, and preferably before a further sheet is stacked on top of it. Regardless of the number of sheets in the stack, the sensor assembly is arranged to sense or scan the top sheet, being the most recently added sheet. The sensor assembly preferably defines a detection position, which detection position is at the top of the stack during the entire stack forming process. This may be achieved by moving the stack support with respect to the sensor assembly, such that the top sheet of the stack is kept at the detection position.

In an embodiment, the controller is configured to emit an error signal when the controller determines that the top sheet was flipped and/or stacked incorrectly. A further sheet is stacked similar to the top sheet, when it was determined that flipping was successfully executed. In case the sensor data indicates that the top sheet was incorrectly flipped, the controller is configured to emit an error signal to one or more different devices. The error signal may be in any suited format.

In an embodiment, the error signal is configured to trigger one or more of the following:

- inform an operator via a user interface;
- stop stacking of sheets onto the stack support; and
- redirect to be stacked sheets to a further flipping device for stacking onto a further stack support.

The error signal may be transmitted to a user interface, such as a screen on a device handled by an operator (e.g. a computer or mobile device). The operator is thereby promptly informed, as the error signal triggers a visual feature to appear on the user interface. The visual feature may comprise information regarding identification of the problem, for example an indication of an incorrectly flipped sheet in a sheet stacker at an indicated location. The error signal may further be transmitted to the flipping device to prevent the flipping of further sheets. Additionally, the error signal may also stop or pause the printing operation of a printer connected to the sheet stacker. In case, the printer has been provided with multiple sheet stackers, the error signal may also control the printer to redirect sheets to another sheet stacker, such that the remainder of the stack may be formed there. The wrongly flipped sheet or sheets are therein preferably reprinted in the correct order, such that the different parts of the stack can be easily merged by the operator.

In an embodiment, the sensor assembly is configured to detect an out-of-plane deformation of the top sheet with respect to the sheet below it. The sensor assembly is arranged to distinguish between the top sheet being flat and/or planar or at least partially deformed, such that portions of the sheet protrude out of a plane parallel to the sheet underneath the top sheet. Since the previous sheets have been correctly stacked, these have a similar planar shape. If the top sheet is flipped incorrectly, its deformation will extend perpendicular to the plane of the underlying sheet. The sensor assembly is arranged to sense such deformations.

In an embodiment, the sensor assembly comprises an optical detector. An optical detector allows for contactless sensing the sheet, thus without the risk of altering its form or position. The detector may be a camera, light sensor, photodiode, etc.

In an embodiment, the sensor assembly further comprises an optical emitter configured for emitting a light beam towards the top sheet. A low costs embodiment of the sensor assembly may be formed by an optical emitter, such as a laser or focused light beam emitter, or even a sufficiently strong lamp. The emitted light can be applied to identify a presence of a deformation in the sheets by the different reflection of light as compared to the flat (non-deformed) areas of the top sheet (or the underlying sheet).

In an embodiment, the emitter and detector are positioned with respect to one another, such that an intensity of light received by the detector from the emitter is different when the top sheet is planar as compared to when the top sheet is non-planar. When the sheet has been correctly flipped and stacked, the top sheet of the stack is flat. The emitter may be positioned such that the light beam extends over the flat surface in that case. When the top sheet is deformed, deformations protrude out of the plane of the light beam and partially obstruct the light beam, reflecting the light beam. This results in a change in the intensity of light received by the detector. Incorrectly flipped sheets can thus be derived from a signal change from the detector. The detector may be positioned opposite to the emitter such that the highest intensity of light is received when the top sheet is planar and that the received intensity is reduced when the sheet comprises deformations reflecting part of the light beam. In an alternative embodiment, the detector is positioned to receive light only when the light beam at least partially reflects of one or more deformations in the sheet, for example in the form of a laser distance meter. The detector in another example may be relatively large and extend over a large portion of the support. Incorrect flipping of a sheet can then be determined from a rise in signal intensity from the detector.

In an embodiment, the emitter and the detector are positioned substantially diagonally on opposite sides of the top sheet with respect to one another. The light beam thereby covers a relatively large portion of the sheet, resulting in a more accurate determination of whether the flipping was executed correctly. It will be appreciated that diagonally is herein defined as roughly parallel to a diagonal direction of the support. Since different sheet dimensions may be applied, while the detector and emitter are stationary with respect to the support, diagonally may be defined as a direction which extends between two points adjacent opposite corners of the top sheet.

In an embodiment, an actuator is provided for adjusting a spacing between the stack support and the flipping device during use, and wherein the sensor is stationary with respect to the flipping device during use. The top of the stack is kept at a constant level with respect to the flipping device to ensure reliable flipping and stacking. As the stack increases, the support is lowered with respect to the flipping device. The sensor and preferably also the detector are however stationary with respect to the flipping wheel during use, for example by being mounted on a common frame.

In an embodiment, the controller is configured for determining position information of an out-of-plane in the top sheet from data from the detector. The controller is able to determine a relative position of a deformation in the top sheet, for example its distance from the emitter or detector or any other relevant point. The positional information can be applied to determine the underlying cause for the incorrect flipping. Simple linear distance sensors or more elaborate scanners or cameras may be applied to obtain the positional information.

In an embodiment, the controller is configured to derive at least one flipping fault parameter from data from the detector and to transmit information for the at least flipping fault parameter to a database with a look-up table for determining a root cause of the flipping fault. The flipping fault parameter may for example be above mentioned positional information. The transmitted information is compared to a look-up table in a database, which can be stored either locally or 'in the cloud'. The look-up table comprises a list with root causes, each root cause being provided with one or more identifiers which allow a root cause to be matched to the at least flipping fault parameter. This allows the controller to identify the underlying problem and take appropriate action.

In an embodiment, the transmitted information for the at least flipping fault parameter comprises at least one of the following:

- positional information of a deformation in the top sheet;
- sheet media information, such as dimensions and/or material properties; and
- operational information of the flipping device, such as operational speeds and/or dimensions.

The positional information gives information regarding the manner in which the sheet collapsed during flipping. This may be combined with information regarding the sheet itself and the flipping operation to determine whether suitable settings for applied for flipping the sheet in the manner it was flipped. The look-up table is preferably based on test and/or operational data.

In an embodiment, he controller is configured:

- to receive an flipping fault root cause identifier determined by comparing information for the at least flipping fault parameter to the look-up table; and
- to display information identifying the flipping fault root cause identifier on a user interface.

After comparison to the look-up table a root cause has been determined and the operator is informed of said root cause. Preferably, the displayed information identifying the flipping fault root cause identifier includes technical specification data which includes instructions for resolving the root cause to help the operator resolve the problem. Alternatively, the operator may have configured the controller to automatically adjust operations based on said received information.

The present invention further relates to a method for stacking sheets comprising the steps of:

- a flipping a sheet onto a stack support or a stack on said stack support;
- sensing whether the flipped sheet comprised an out-of-plane deformation for each sheet in the stack individually, followed by either:
- flipping a further sheet onto the sheet in case no out-of-plane deformation was detected; or
- preventing further flipping of sheets and emitting an error signal.

The method may be performed on a sheet stacker as described above. Therein a controller determines from a signal from a detector whether a sheet has been correctly flipped or not. In case of correct flipping, the stacking operation is continued and a new sheet is flipped and stacked on top of the previous sheet. In case of an incorrectly flipped sheet, the controller emits an error signal. The error signal may for example stop the flipping by pausing or stopping the flipping device, inform an operator via a user interface, and/or reroute the to be stacked sheets to an alternative sheet stacker.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE PREFERRED EMBODIMENTS

Figure 1:
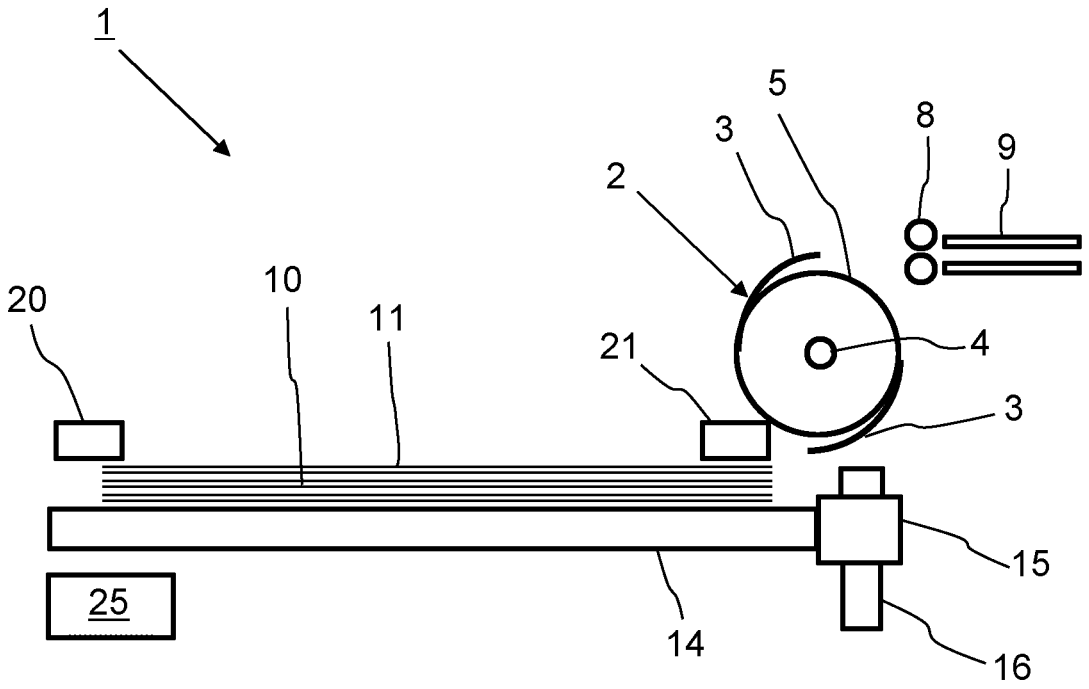
FIG. 1 is a schematic side view of an embodiment of a sheet stacker according to the present invention.

The present invention will now be described with reference to the accompanying drawings, wherein the same reference numerals have been used to identify the same or similar elements throughout the several views.

FIG. 1 illustrates schematically a side view of a sheet stacker 1. The sheet stacker 1 is positioned at the end of a sheet transport path formed by a transport pinch 8 downstream of one or more sheet guides 9. The transport pinch 8 is positioned to feed sheets into one of the slots 3 of the flipping device 2. The slots 3 are configured to releasably hold a leading edge of a sheet, as the flipping device 2 is rotated around its axis 4. This results in the sheet being flipped with respect to the orientation it in the transport pinch 8 and/or at the sheet guides 9. A stop element (not shown) is positioned underneath the flipping device 2, such that contact between the sheet and the stop element releases the sheet from the slot 3. Thereby, sheets can be stacked quickly onto the stack support 14. It will be appreciated that the flipping wheel 5 may be provided with one, two, or any suitable number of slots 3. Such a flipping device 2 is described in detail in U.S. Pat. No. 9,457,980 BB which description is hereby incorporated by reference.

While stacking, the stack 10 on the stack supports 14 grows. An actuator 15 is provided for raising and lowering the stack support 14 with respect to the flipping device 2, such that the top surface of the stack 10 is at the correct height position for receiving the sheet from the flipping device 2. The actuator comprises a drive 15 mounted on a spindle 16, though other suitable actuators and supports may be applied.

A sensor assembly formed of an emitter 20 and a detector 21 is provided at the level of the top sheet 11 of the stack 10. The sensor assembly is arranged to sense the top sheet 11 in order to determine whether the top sheet 11 was flipped successfully, i.e. whether the top sheet 11 has regained its flat or planar shape after flipping. The sensor assembly is configured to detect the presence of any out-of-plane deformations in the top sheet S, such as folds, or wrinkles. It will be appreciated that very small out-of-plane deformations in the top sheet 11 may be allowed and do not render the top sheet 121 as incorrectly flipped.

Figure 2:
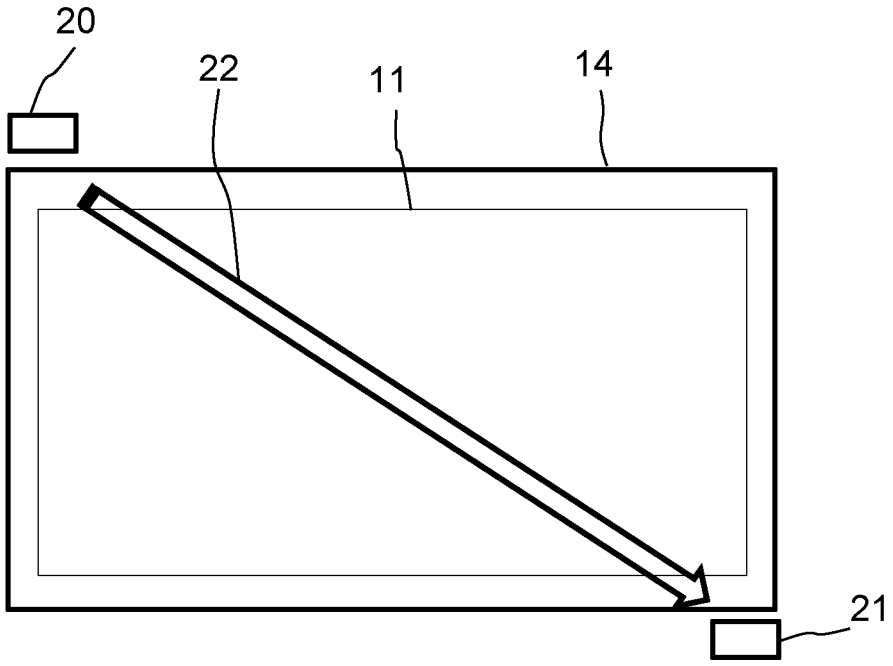
FIG. 2 is a schematic top view of the sheet stacker in FIG. 1 with a correctly flipped sheet.

In the embodiment in FIG. 1, the sensor assembly comprises an optical emitter 20, such a laser or (focused) light source. The output of the emitter 20 is such that its emission will be disturbed by any out-of-plane deformations in the top sheet 11. An example is illustrated in FIG. 2, wherein the top sheet 11 has been successfully flipped onto the stack support 14 (or the stack already positioned thereon). The light beam 22 emitted by the emitter 20 is allowed to travel unobstructed over the top sheet 11 towards the detector 21. In FIG. 2, the emitter 20 and the detector are positioned, such that the light beam 22 travels over a substantial portion of the top sheet 11 at a non-zero angle with respect to the edges of the top sheet 11. It is preferred to have the light beam 22 travel substantially diagonally over the top sheet 11, though the degree of diagonality may vary dependent on the dimensions of the top sheet 11 and its position with respect to the emitter 20 and detector 21. The sensor assembly has been rigidly fixed with respect to the flipping device 2, for example by mounting it on the same frame.

The intensity of light received by the detector 21 is compared by the controller (25 in FIG. 1) to a predetermined threshold, which may be a value or setting stored on a memory of the controller 25. The threshold may e.g. be set before stacking by measuring the received light intensity before a sheet is flipped onto the stack support 14. A safety or correction value may be applied to this measurement. For example the threshold may be 90%, 80%, 70%, etc. of this measured intensity. After flipping a sheet, the controller 25 compares whether the detected light intensity with the threshold, and if said detected light intensity is above said threshold, the top sheet 11 is assumed to be free of out-of-plane deformations. The controller 25 based on that determines that the top sheet 11 has been successfully flipped and commences the flipping of a further sheet.

Figure 3:
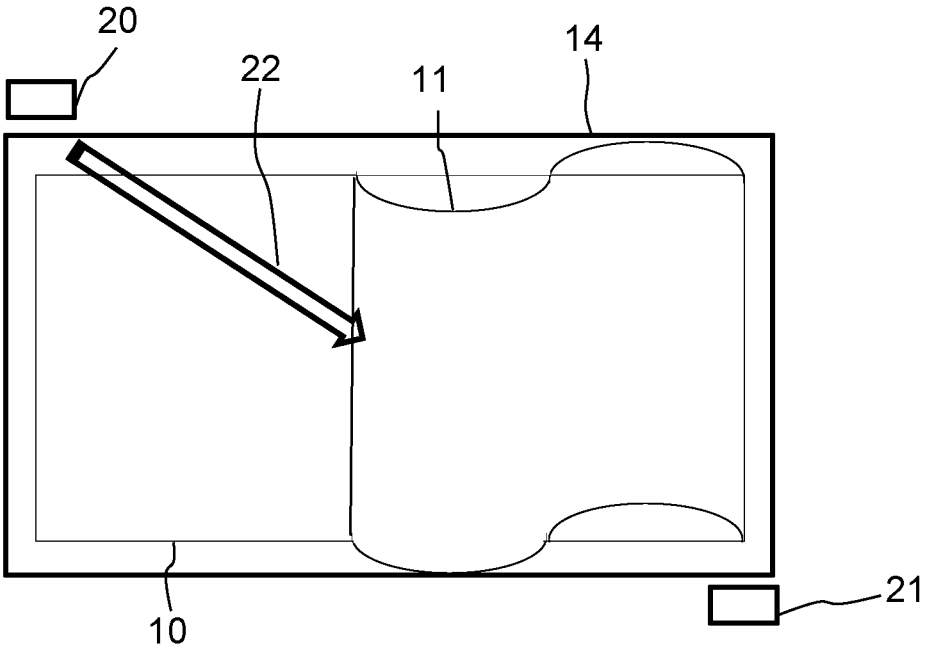
FIG. 3 is a schematic top view of the sheet stacker in FIG. 1 with an incorrectly flipped sheet.

In FIG. 3, the top sheet 11 has been incorrectly flipped. The top sheet 11 has collapsed upon itself while in the flipping device 2, resulting in one or more folds protruding out of the plane of the top of the stack 10. The light beam 22 is at least partially prevented from reaching the detector 21. The detected light intensity in FIG. 3 is lower than that the threshold and the controller 25 determines that the top sheet 11 has been flipped incorrectly. The controller 25 then proceeds to emit an error signal, which prevents a further sheet from being flipped onto the stack 10. It will be appreciated that in case of high stacking speeds, the error signal from the controller 25 may be too late to prevent the subsequent one or more sheets to be stacked on the top sheet 11 before stopping the flipping device 2.

Figure 4:
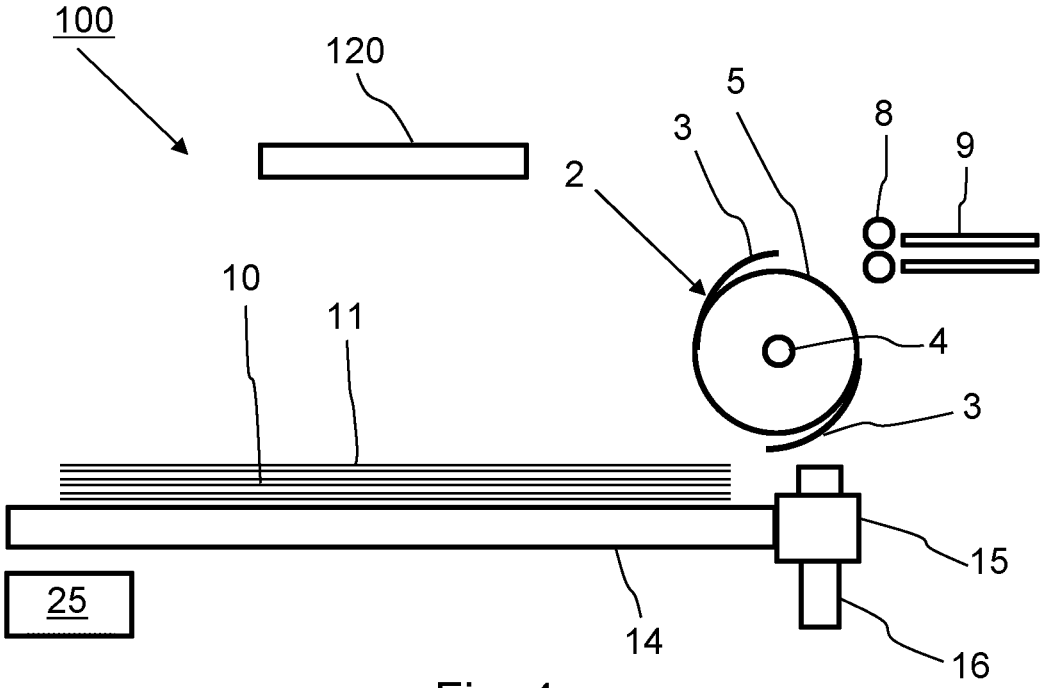
FIG. 4 is a schematic side view of another embodiment of a sheet stacker according to the present invention.

FIG. 4 illustrates another embodiment of the sheet stacker 100, wherein the sensor assembly is formed by a camera 120 arranged to image the top surface of the stack 10. Additional light sources may be provided to improve the workings of the camera 120. The controller in this embodiment is provided with image analysis software, which may detect out-of-plane deformations from e.g. dark and light contrasting areas in the sensed image of the top sheet 11. A successfully flipped top sheet 11 will yield a substantially homogenous image, while for examples wrinkles, folds, or dog-ears will show up as having dark lines. In another example, the sensor assembly may utilize a 3D scanner.

Figure 5:
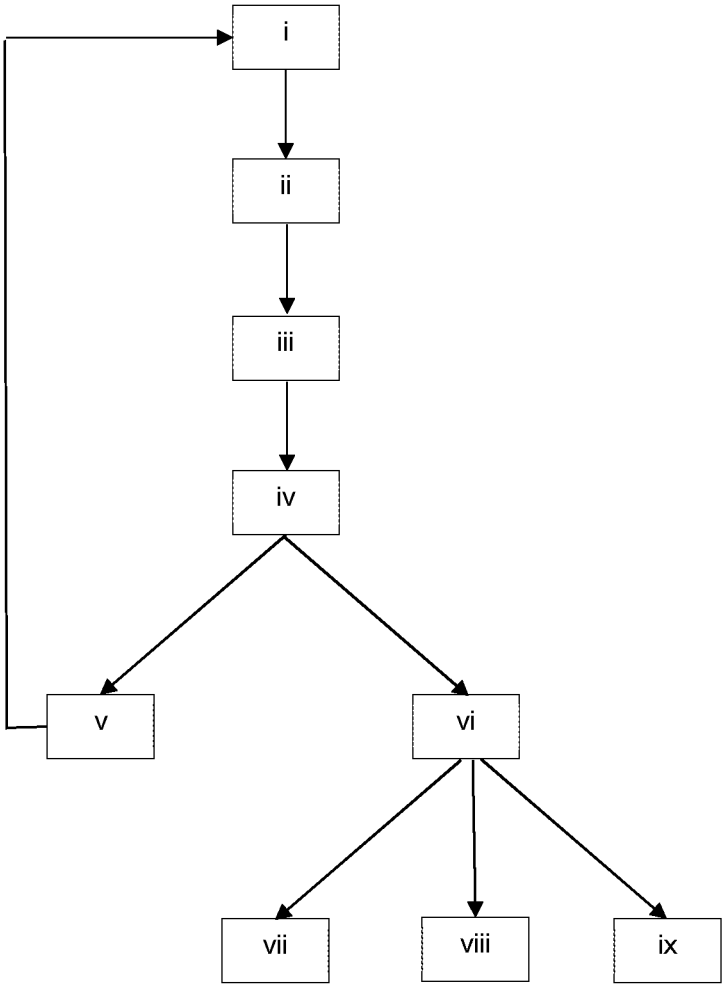
FIG. 5 is a block diagram illustrating the steps of the method according to the present invention.

FIG. 5 illustrates the steps of the method according to an embodiment of the present invention. In step i a sheet is transported from the sheet transport path, where the sheet has a first orientation, into the sheet flipping device 2. The sheet flipping device 2 in step ii flips the sheet into a second orientation, wherein the surfaces of the sheet are reversed with respect to the first orientation. The sheet is thereby positioned onto the stack support 14 or a stack 10 on said stack support 14. Step iii comprises the sensor assembly sensing the sheet. Data from the sensor assembly is transmitted to the controller 25. In step iv, the controller 25 based on said data determines whether the sheet has been successfully flipped. The controller 25 preferably does this by comparing the data to a threshold, which threshold is a measure for out-of-plane deformation in the top sheet 11. The determination step iv can have one of two outcomes, illustrated by steps v and vi. Step v illustrates the case wherein the controller 25 determines that the top sheet 11 is substantially free of out-of-plane deformation and thus has been successfully stacked. The stack 10 in that case is then ready for receiving a further sheet and the controller 25 proceeds to repeat steps i to iv.

Step vi illustrate the situation wherein the controller 25 determines the top sheet 11 to have been incorrectly flipped, which has resulted in one or more out-of-plane deformations in the top sheet 11. This triggers the controller 25 to execute one or more of the steps vii to ix. Step vii comprises stopping the operation of the flipping device 2 to prevent further sheets from being stacked on the incorrectly flipped top sheet 11. Step viii may also be executed, in which the controller instructs further sheets to be directed to another flipping device for forming the remained of the stack there. This allows the stacking operation to be continued, but it requires multiple sheet stackers connected to a single source or printer. Step ix comprises the controller 25 emitting the error signal towards one or more user interfaces, where the received error signal prompts a warning or status indication to appear on the user interface. The operator is thereby informed that a stacker is offline and requires maintenance. Additionally, in case step viii has been performed the operator may informed that stack has been completed, but was divided over different output locations.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A sheet stacker comprising:

a flipper for flipping a sheet with respect to an orientation of the sheet before being received by the flipper onto a stack support or a stack of sheets on said stack support;

sensors arranged for detecting an out-of-plane deformation of a top sheet with respect to the stack support or the stack of sheets on said stack support at least for each sheet added to the stack; and a controller configured to determine from data from the sensors whether the top sheet was successfully flipped and stacked, wherein the sensors and the stack support are movable with respect to one another, wherein the sensors define a detection position and are arranged such that the detection position is at the top of the stack during an entire stack forming process, wherein the sensors further comprise an optical emitter configured for emitting a light beam towards the top sheet and a detector, wherein the optical emitter and the detector are positioned with respect to one another such that an intensity of light received by the detector from the emitter is different when the top sheet is planar as compared to when the top sheet is non-planar, and wherein the light beam is parallel to an undeformed top sheet.

2. The sheet stacker according to claim 1, wherein the sensors are arranged to sense each sheet added to the stack individually after the respective sheet has been added to the stack.

3. The sheet stacker according to claim 1, wherein the controller is configured to emit an error signal when the controller determines that the top sheet was flipped and/or stacked incorrectly.

4. The sheet stacker according to claim 3, wherein the error signal is configured to trigger one or more of the following:

inform an operator via a user interface;

stop stacking of sheets onto the stack support; and redirect to be stacked sheets to a further flipper for stacking onto a further stack support.

5. The sheet stacker according to claim 1, wherein the sensors are configured to detect an out-of-plane deformation of the top sheet with respect to a sheet below the top sheet.

6. The sheet stacker according to claim 1, wherein the detector comprises an optical detector.

7. The sheet stacker according to claim 1, wherein the emitter and the detector are positioned substantially diagonally on opposite sides of the top sheet with respect to one another.

8. The sheet stacker according to claim 1, wherein an actuator is provided for adjusting a spacing between the stack support and the flipper during use, and wherein a detector of the sensors is stationary with respect to the flipper during use.

9. The sheet stacker according to claim 1, wherein the controller is configured for determining position information of an out-of-plane in the top sheet from data from a detector of the sensors.

10. The sheet stacker according to claim 1, wherein the controller is configured to derive at least flipping fault parameter from data from a detector of the sensors and to transmit information for the at least flipping fault parameter to a database with a look-up table for determining a root cause of a flipping fault.

11. The sheet stacker according to claim 10, wherein the transmitted information for the at least flipping fault parameter comprises at least one of the following:

positional information of a deformation in the top sheet;

sheet media information; and operational information of the flipper.

12. The sheet stacker according to claim 11, wherein the controller is configured:

to receive a flipping fault root cause identifier determined by comparing information for the at least flipping fault parameter to the look-up table; and to display information identifying the flipping fault root cause identifier on a user interface.

13. The sheet stacker according to claim 12, wherein the displayed information identifying the flipping fault root cause identifier includes technical specification data which includes instructions for resolving the root cause.

14. A method for stacking sheets comprising the steps of:

flipping a sheet onto a stack support or a stack on said stack support; and sensing whether the flipped sheet comprised an out-of-plane deformation for each sheet in the stack individually, followed by either:

flipping a further sheet onto the sheet in case no out-of-plane deformation was detected; or preventing further flipping of sheets and emitting an error signal, deriving at least one flipping fault parameter from data from a detector; and transmitting information for the at least one flipping fault parameter to a database with a look-up table for determining a root cause of a flipping fault.

15. A sheet stacker comprising:

a flipper for flipping a sheet with respect to an orientation of the sheet before being received by the flipper onto a stack support or a stack of sheets on said stack support;

sensors arranged for detecting an out-of-plane deformation of a top sheet with respect to the stack support or the stack of sheets on said stack support at least for each sheet added to the stack; and a controller configured to determine from data from the sensors whether the top sheet was successfully flipped and stacked, wherein the controller is configured to derive at least flipping fault parameter from data from a detector of the sensors and to transmit information for the at least flipping fault parameter to a database with a look-up table for determining a root cause of a flipping fault.

* * * * *